US006851367B2

(12) United States Patent
Vaidyanathan et al.

(10) Patent No.: US 6,851,367 B2
(45) Date of Patent: Feb. 8, 2005

(54) WEB HANDLING CYLINDER WITH MODULATED TENSION LOSS

(75) Inventors: Nandakumar Vaidyanathan, Litchfield, NH (US); Steven Degon, Northboro, MA (US); Robert Bruce Lowd, Chestnut Hill, MA (US); Brian Roland Lamoureux, Pelham, NH (US); Keith Vaillancourt, Pelham, NH (US); James Hand, Pelham, NH (US)

(73) Assignee: Presstek, Inc., Hudson, NH (US)

( * ) Notice: Subject to any disclaimer, the term of this patent is extended or adjusted under 35 U.S.C. 154(b) by 0 days.

(21) Appl. No.: 10/632,238

(22) Filed: Jul. 31, 2003

(65) Prior Publication Data

US 2004/0025726 A1 Feb. 12, 2004

Related U.S. Application Data

(60) Provisional application No. 60/402,006, filed on Aug. 8, 2002.

(51) Int. Cl.[7] ..... B41F 27/00
(52) U.S. Cl. ..... 101/477
(58) Field of Search ..... 101/415.1, 477; 242/538.2, 538.3, 410; 399/161

(56) References Cited

U.S. PATENT DOCUMENTS 3,737,230 A * 6/1973 van Meijel et al. ..... 355/111
3,854,329 A 12/1974 Jones
3,974,974 A * 8/1976 Nishikawa ..... 242/538.3
3,982,710 A 9/1976 Teumer
4,473,009 A 9/1984 Morgan
5,024,156 A 6/1991 Hank et al.
5,130,744 A 7/1992 Hisada
5,413,043 A * 5/1995 Fuhrmann et al. ..... 101/415.1
5,435,242 A * 7/1995 Kusch et al. ..... 101/142
5,470,005 A 11/1995 King et al.
5,521,844 A 5/1996 Karis
5,602,747 A 2/1997 Rajala
5,712,489 A 1/1998 Elvidge et al.
5,727,749 A 3/1998 Pensavecchia et al.
5,757,641 A 5/1998 Minto
5,878,933 A 3/1999 Laughery
5,944,958 A 8/1999 Svanqvist
5,992,789 A 11/1999 Lamothe
6,026,747 A 2/2000 Carme et al.
6,106,177 A 8/2000 Siegl et al.
6,168,108 B1 1/2001 Morley
6,176,410 B1 1/2001 Ueda et al.
6,250,220 B1 6/2001 Sainio et al.
6,293,031 B1 9/2001 Ringbom et al.
6,314,333 B1 11/2001 Rajala et al.
6,325,322 B1 12/2001 Lewis
6,525,754 B2 * 2/2003 Landolt ..... 347/139
2001/0006029 A1 7/2001 Ogawa et al.

* cited by examiner

*Primary Examiner*—Stephen R. Funk
(74) *Attorney, Agent, or Firm*—Testa, Hurwitz & Thibeault, LLP

(57) ABSTRACT

Systems and related methods are provided for modulating web tension loss at the edge of spool-hosting cavities in a cylinder by displacing the feed path and/or the exit path of the web material.

34 Claims, 11 Drawing Sheets

WEB HANDLING CYLINDER WITH MODULATED TENSION LOSS

CROSS-REFERENCE TO RELATED APPLICATIONS

This application is based on, and claims priority to, U.S. provisional patent application Ser. No. 60/402,006, filed Aug. 8, 2002, the entire disclosure of which is herein incorporated by reference.

BACKGROUND OF THE INVENTION

1. Field of the Invention

The present invention relates to digital printing apparatus and methods, and more particularly to an apparatus for continuously supplying lithographic printing material to the plate cylinder of a planographic printing press or a plate-material imager.

2. Background

Traditional techniques of printing an image onto a recording medium, such as paper, include letterpress printing, gravure printing and offset lithography. All of these printing methods require the use of plate material. This plate material is usually loaded onto a rotating plate cylinder that is brought into pressurable contact with the recording/printing medium.

In letterpress printing, the image is represented on the plate material as raised surfaces that accept ink and transfer it onto the medium. Gravure plates, in contrast, define a series of wells or indentations that accept ink for deposit onto the recording medium. Excess ink is removed from the plate material using a doctor blade or another similar device prior to contact between the plate and the recording medium.

In offset lithography, an image is defined on a printing plate defined by ink-accepting (oleophilic) areas surrounded by ink-repellent (oleophobic) surfaces. Two different lithographic systems are generally employed in offset lithography. In a dry printing system, the plate material is simply inked, and the image is transferred onto a recording/printing medium. First, the plate material makes contact with a compliant intermediate surface called a blanket cylinder which, in turn, applies the image to the paper or other medium. The paper is typically pinned to an impression cylinder in rolling contact with the blanket cylinder, which applies ink to the paper in accordance with the image.

In a wet lithographic system, the non-image areas are hydrophilic, and the necessary ink-repellency is provided by an initial application of a dampening (or "fountain") solution to the plate material prior to inking. The fountain solution prevents ink from adhering to the non-image areas but does not affect the oleophilic character of the image areas.

In any lithographic system, accurate image transfer requires that the plate material remain relatively stationary on the cylinder surface during printing. Accordingly, different techniques have been developed for affixing plate material to underlying plate cylinders. Basic offset printing systems involve stationary clamping of a flexible length of plate material to the plate cylinder, while more advanced systems such as those described in U.S. Pat. Nos. 5,355,795 and 5,727,749 (both co-owned with the present application, and expressly incorporated herein by reference) use a relatively long length of plate material or web material stored in the form of rolls within a well or cavity in the plate cylinder. In these systems, a new segment of the plate or web material is advanced around the plate cylinder following completion of a print job. The new segment is imaged by an electronically controlled print head, which applies a print pattern to the surface. In these systems, it is critical that sufficient tension be maintained in the web material wrapped around the cylinder surface.

DESCRIPTION OF THE INVENTION

Brief Summary of the Invention

It has been discovered that tension loss occurs at the edges of the well or cavity in the cylinder where the web material is either fed onto the cylinder surface or the web material comes off the cylinder surface. The present invention is directed toward reducing the tension loss at these edges.

In accordance with the present invention, there is provided a web-winding device, e.g., a spool, that wraps a web material around a cylinder along a travel path that leads from an interior of the cylinder over a cylinder surface and back into the interior. The winding device includes a tension adjuster that adjusts the web tension by displacing a portion of the web material in relation to a plane tangent to a web contact point on the cylinder. The contact point is where the web feeds onto or comes off the cylinder surface. The interior of the cylinder may include multiple cavities where the winding device may be disposed in.

In another aspect of the invention, a web-handling system is provided that includes a cylinder, a first winding device, a second winding device, and a displacement device. The cylinder has a circumferential surface and at least one cavity. Each cavity has a pair of edges on the cylinder surface. The edges may be round and differ from the rest of the circumferential surface in radius. The winding devices are disposed in the same cavity or separate cavities in the cylinder. The first winding device feeds a web material onto the circumferential surface of the cylinder along a feed path. The second winding device receives the web material off the cylinder surface along an exit path. There can be more than one pair of winding devices. The displacement device displaces at least one of the web paths for adjusting web tension.

For example, the displacement device can displace at least one of the winding devices. Alternatively, the displacement device can be a dancer roll or an angular displacement arm that is in contact with at least one of the web paths. The displacement device can travel along a linear or a curved trajectory. The displacement device may displace at least one of the web paths in relation to a tangent plane at a web-contact point on the cylinder. The displacement device may be capable of maintaining the web path substantially in the tangent plane to minimize web tension loss at the cavity edges.

The web-handling system may further include a sensing device that senses a tension in the web and generates a signal to actuate the displacement device, e.g., when sensing a loss of tension. The sensing device may be a sensor that is associated with the circumferential surface of the cylinder and that detects a force applied by the web against the surface. The system can also include a processor that receives an input from the sensing device, processes the input and sends an output to the displacement device. The system of the invention may be able to maintain a set value for the web tension.

There is further provided a method for adjusting tension in a web material that feeds onto and comes off a cylinder's circumferential surface. The method involves displacing a portion of the web material in relation to a plane tangent to a web contact point on the cylinder. The method may further include maintaining a portion of the web substantially in the tangent plane. The method may use at least one spool disposed in a cavity in the cylinder for winding the web material. Where the edges of the cavity are round and differ from the rest of the cylinder's circumferential surface in radius, the method may include a step of displacing the web material such that the web contact point is not on the round edges, e.g., behind the edges.

BRIEF DESCRIPTION OF THE DRAWINGS

The foregoing discussion will be understood more readily from the following detailed description of the invention, when taken in conjunction with the accompanying drawings, in which.

The drawings are not necessarily to scale, emphasis instead generally placed upon illustrating the principles of the invention.

DETAILED DESCRIPTION OF ILLUSTRATIVE EMBODIMENTS

The present invention is useful in conjunction with any type of mechanism that advances sheet or web material around a cylinder. A device is provided by the present invention that adjusts the web tension where the web material meets the cylinder surface.

Figure 1:
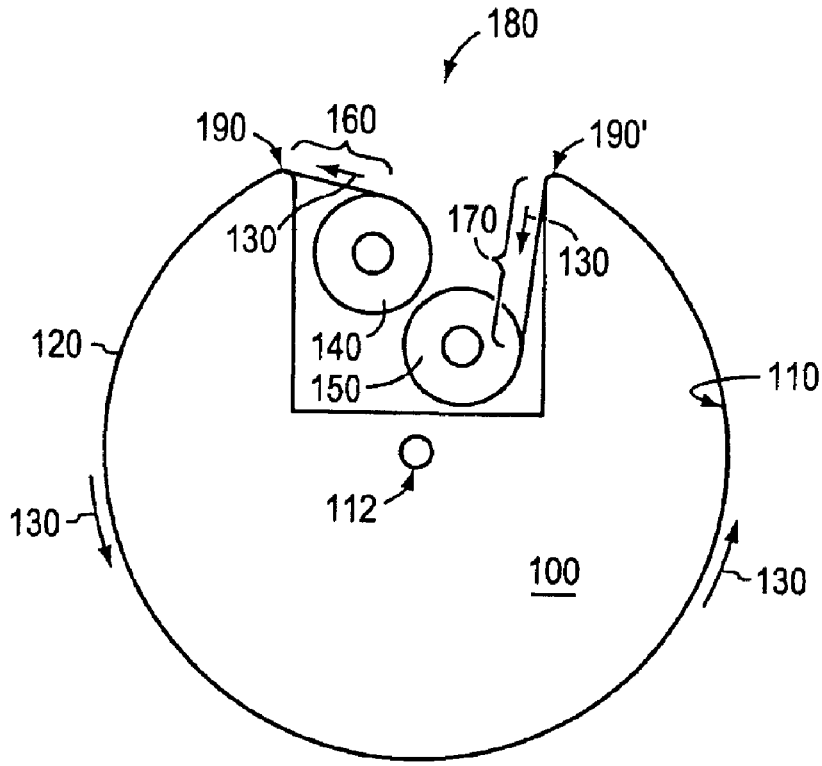
FIG. 1 (PRIOR ART)
FIG. 1 is an end view of a cylinder that can incorporate the present invention.

FIG. 1 illustrates the problem of tension loss in existing cylinders. A cylinder 100 with a circumferential surface 110 is shown in cross-section. The cylinder 100 may be stationary or rotatable around an axis 112. A web material 120, e.g., of paper, plastic, fabric, or metal, and in a suitable form, e.g., a rope, a sheet, or a plate, is wrapped around at least a portion of the cylinder circumference 110. The web material 120 may be stationary or traveling. For example, a traveling web, due to one or more motors (not shown) that either pull the web material 120 or rotate the cylinder 100, may advance around the portion of the cylinder's circumference 110 in a direction denoted by the arrows 130.

The web material 120 may be wound on two winding devices, e.g., a supply spool 1140 and an uptake spool 150. The web material 120 is fed from the supply spool 140 to the cylinder's circumferential surface 110, and travels along a feed path 160 from a surface of the supply spool 140 to the cylinder's surface 110. After traversing at least a portion of the cylinder's circumferential surface 110, the web material 120 leaves the cylinder 100 and is wound onto the uptake spool 150 along an exit path 170 from the cylinder's surface 110 to a surface of the uptake spool 150.

Still referring to FIG. 1, the pair of spools 140 and 150 may be disposed in one or more cavities or recesses 180 in the cylinder 100. The cavity 180 borders the circumferential surface 110 at a pair of edges, i.e., a feeding edge 190 and an exit edge 190'. The edges 190 and 190' may be round corners. The web material 120 is fed onto the cylinder's circumferential surface 110 at the feeding edge 190 and comes off the cylinder surface 110 at the exit edge 190'. There may be more than one pair of supply and uptake spools 140 and 150, which may be disposed in more than one cavities 180 in the cylinder 100.

The web tension T and the normal load or force N on the cylinder's surface 110 are related through the formula $N=T/(W\times R)$, where W is the web width and R is the radius of the cylinder. By measuring the normal load N on the cylinder surface, for example, it can be shown that around both edges 190 and 190' where the web material 120 meets or contacts the cylinder's circumferential surface 110, the web tension T decreases substantially.

The present invention provides devices and methods for modulating the tension loss around the edges 190 and 190'. By modulating the tension loss, more consistent tension distribution in the web around the cylinder surface 110 can be achieved. In particular, by reducing the tension loss at the cylinder edges 190 and 190', more web tension may be distributed to the portion of the web wrapped around the cylinder's surface 110, resulting in tighter wrapping and less likelihood of web slippage.

Figure 2:
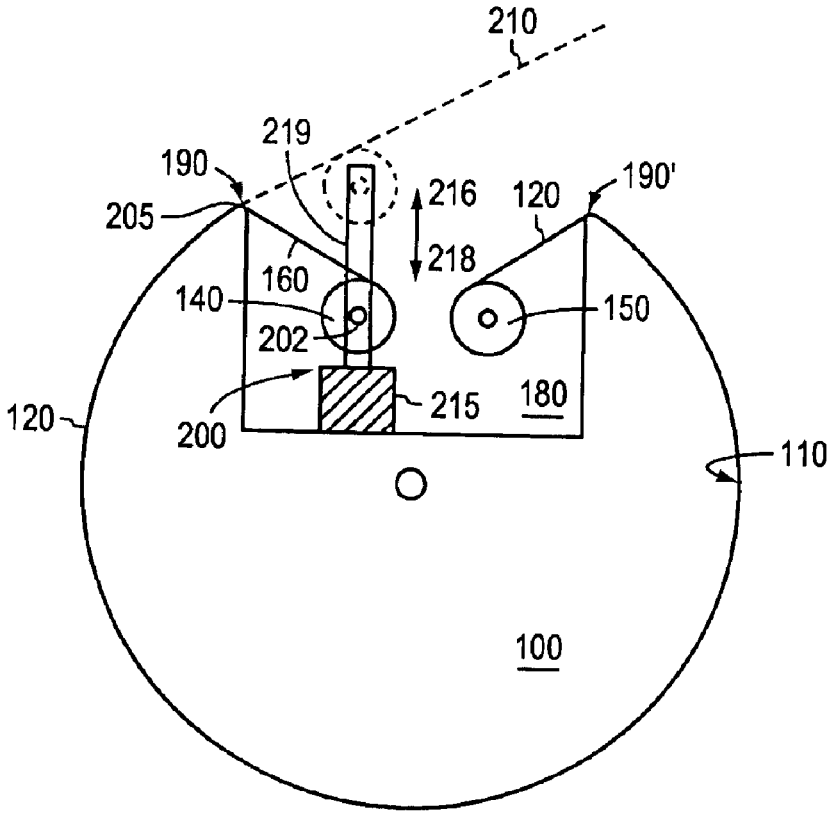
FIG. 2 is a partially schematic end view of an embodiment of a displacement device in accordance with the present invention.

Referring to FIG. 2, in an embodiment of the present invention, a displacement device 200 is provided that adjusts the tension in the web material 120. The web material 120 is wound on a winding device and fed along a feed path 160 onto the feeding edge 190 of the cavity 180 in the cylinder 100. An example of a winding device is a supply spool 140 that rotates around its axis 202. The feed path 160 extends from the surface of the web material wound on the supply spool 140 to a contact point 205 around the edge 190 where the web material 120 first meets the cylinder surface 110. It has been found that tension loss is minimized if the feed path 160 is in a plane 210 that is tangent to the cylinder 100 at the contact point 205.

The displacement device 200 adjusts the web tension by displacing a portion of the web material 120 in relation to the tangent plane 210. The displacement device may use an actuating mechanism, e.g., a conventional motor, a rotating electric motor, a linear electric motor, a stepper motor, a pneumatic piston, or a hydraulic piston, to displace the web material 120. The exemplary displacement device 200 shown in FIG. 2 displaces the web material 120 by displacing the supply spool 140 along a linear trajectory indicated by the arrows 216 and 218. In other words, the winding device shown in this particular embodiment travels in a linear trajectory. The trajectory for web displacement may include a curved portion.

The displacement device 200 may optionally have a base 215 that is disposed on a surface in the cavity 180. The device 200 causes the axis 202 of the supply spool 140 to move within a frame 219 in fixed relation to the base 215. As the supply spool 140 moves in the direction of arrow 216, the feed path 160 gets closer to the tangent plane 210, and less web tension is lost at the contact point 205. Conversely, as the supply spool 140 moves in the direction of arrow 218, the feed path 160 gets farther away from the tangent plane 210, and more web tension is lost at the contact point 205. Therefore, the frame 219 can be designed to set limits that correspond to a range of desired tension adjustments. To minimize web tension loss, the feed path 160 is ideally in the tangent plane 210. However, in some applications, such as where another cylinder surface is in rotational contact with the cylinder 100, it may be necessary to retain the surface of the winding device within the cylinder's circumferential envelope. In those cases, the displacement device 200 can move the feed path 160 as far as it can in the direction of arrow 216, such that the feed path 160 is substantially in the tangent plane 210. Moreover, the curvature of the edge at the contact point 205 may be contoured to bring the tangent plane 210 closer to or within the cylinder envelope. It should be noted that the displacement device 200 described above can be similarly constructed to displace the uptake spool 150.

In another aspect of the invention, the displacement device may be further connected to a sensing device that provides information on the web tension. The sensing device can include any sensor that provides information related to the web tension, such as those described in U.S. Pat. No. 5,878,933 to Laughery, and U.S. Pat. No. 5,470,005 to King et al., both incorporated herein by reference. The sensed information is used to actuate the displacement device to adjust web tension by modulating tension loss at the point where the web is fed onto or comes off the cylinder surface. A processor may be included in an embodiment to receive an input from the sensing device, to process it, and then to send an output to the displacement device. The processor may compare the received input to a set value related to web tension in order to decide if adjustment should be made. The set value may be in the form of a tolerance range.

Figure 3:
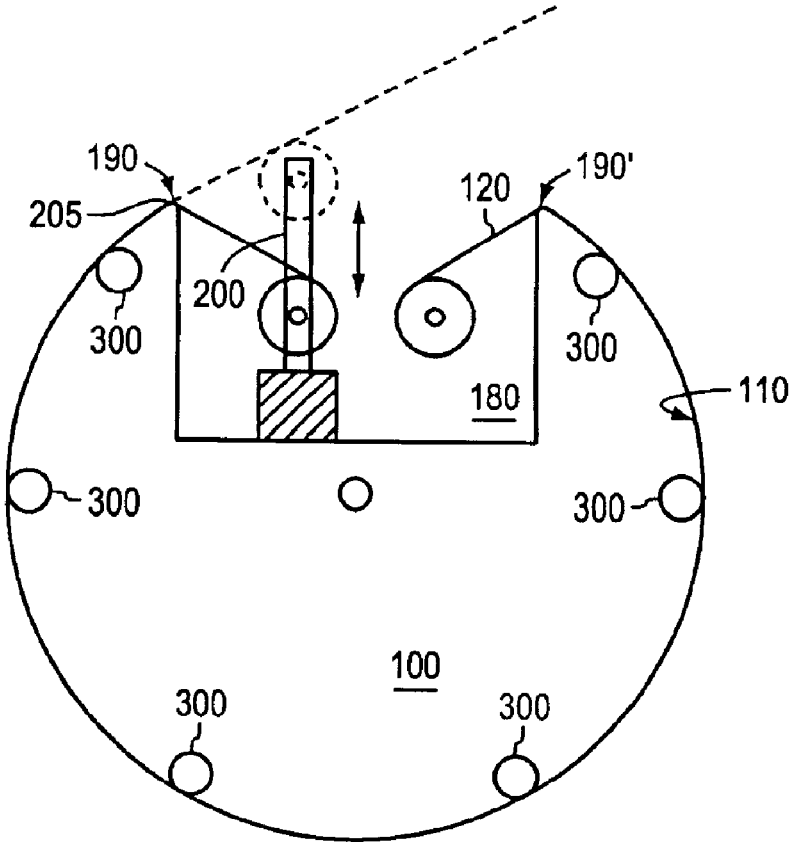
FIG. 3 is a partially schematic end view of the device in FIG. 2 with associated sensing device in accordance with the present invention.

Referring to FIG. 3, in an exemplary embodiment, a sensing device includes one or more sensors 300 that are associated with the circumferential surface 110 of the cylinder 100. For example, multiple sensors 300 may be affixed on the circumferential surface 110, or the sensors 300 may be implanted in the surface 110. The sensors 300 are preferably close to the edges 190 and 190' of the cavity 180. The sensors 300 may detect a parameter related to web tension, e.g., the normal load N. The sensors 300 may be spread out at certain intervals along the cylinder surface 110 to profile the normal load, i.e., the web force exerted at various points against the cylinder surface 110. Moreover, monitoring of the normal load by the sensors 300 can be intermittent or continuous.

Once the normal load is detected by the sensors 300, that data may be used to activate the displacement device 200. Preferably, the information is sent to a processor (not shown) and compared against a set value before adjustment in web tension is made. Once the adjustment is made, the sensors 300 detect deviations from the desired normal load on an ongoing basis. As a result, an automatic or "smart" adjustment system is provided to maintain the optimal web tension.

In one embodiment, the sensors 300 includes one or more force sensitive resistors (FSR), for example, those available from Interlink Electronics of Santa Barbara, Calif. FSRs usually contain a resistive ink patch sandwiched between two layers of polyester film. In a preferred embodiment, the FSR or FSR-based sensors are about 5 mils (0.127 mm) or less in thickness. When a normal force or load is applied on the FSR, the resistive ink patch causes a decrease in the sensor's resistance, which may be read out through a connected ohmmeter or multimeter.

In other embodiments, examples of the sensor 300 include a load cell, e.g., a button load cell, and a piezo-electric sheet based sensor. Piezo-electric sheet based sensors, for example, are suitable for detecting changes in a mechanical force with time.

Figure 4:
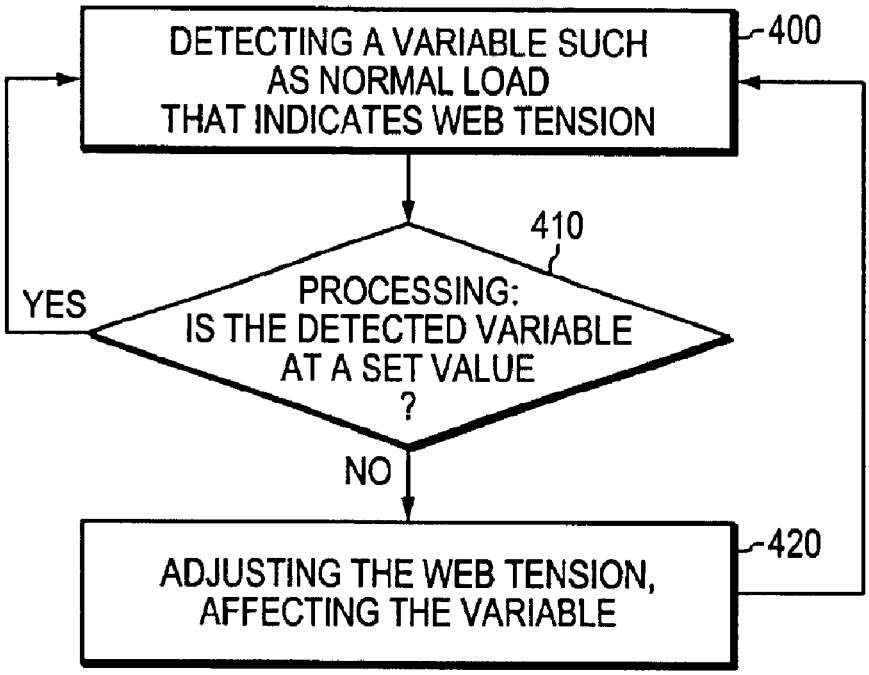
FIG. 4 is a flow chart outlining steps for a method in accordance with an embodiment of the present invention.

Referring now to FIG. 4, a block diagram is shown to illustrate a method and its corresponding system embodied in the invention. In an initial step 400, a sensing device detects a variable that indicates web tension. For example, the sensing device can be sensors associated with the cylinder's circumferential surface that detect the normal load applied by the web against the cylinders s surface. Then, the sensed data is processed against a set value in step 410. That set value may be a single value or a range of acceptable values. If the detected variable is at the set value, the system goes back to the detection step 410 and follows rest of the protocol. These steps can be repeated indefinitely until the detected variable, e.g., normal load, is no longer at the set value. If the detected variable is not at the set value, a step 420 is taken to adjust the web tension, causing the detectable variable to change. The adjusting may be performed by the displacement device. The adjusted variable is detected by the same sensing device (step 400) and processed by comparing at the set value (step 410). Again, further adjustment is made if the variable is still not at the set value. Otherwise the protocol loops back to the detection step 400 and continues down the protocol. As a result, an automatic system is provided that can monitor the normal force continually or intermittently at a preset interval.

A variety of layout options are possible for the sensors. In an exemplary embodiment illustrated in FIG. 5, the sensors 300 are affixed on the circumferential surface 110 of the cylinder 100 in arrays parallel to the cylinder's axis 112. Each array may contain as many sensors 300 as needed to detect the normal load. The entire cylinder surface 110 may contain as many arrays as needed to produce a profile of the normal load to a desired resolution. All the sensors 300 may be connected to a data bus 501. The data bus 501, which may be a conductive cable or an optical fiber, for example, may be further connected to a telemetric device (not shown) that sends sensed data, e.g., via radio signals, to a remote processor. Alternatively, the data bus 501 may be connected to a slip ring 510 or a similar device disposed on the cylinder axis 112. The slip ring 510 prevents the wiring from becoming entangled as the cylinder 100 rotates around its axis 112. The slip ring 510 may be connected, via a cable 520, to a computer system 530 having data processing functions. Optionally, the cable 520 links to a readout meter 540, e.g., a multimeter if the sensors 300 are FSRs, before leading into the computer system 530.

If the sensor 300 is thin enough, e.g., an FSR, it may be associated with the cylinder surface 110 by simply affixing it thereto, e.g., by an adhesive or glue, without substantially affecting the operation of the cylinder 100. Otherwise, the cylinder surface 110 may be machined to contain a recess, a cavity or a slot that fits the sensor 150. The sensor 300 may be disposed in the recess such that the sensor's force-sensitive surface is substantially flush with the cylinder surface 110. Necessary wiring, e.g., the sensor data bus 501 and connection between the data bus 501 and sensors 300, may also be affixed to the cylinder surface 110 or etched thereon as conductive traces or machined into the cylinder surface 110.

Figure 5:
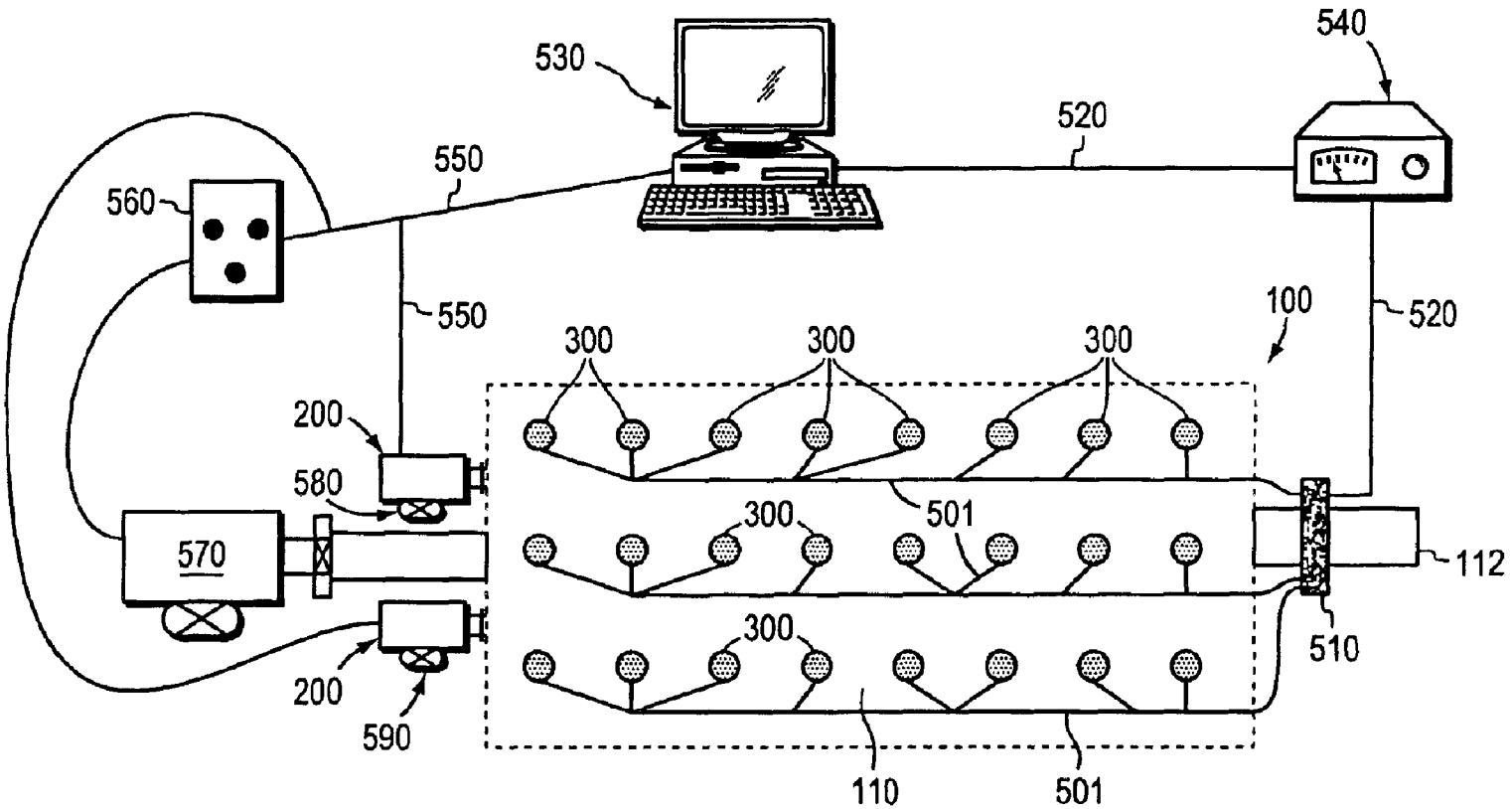
FIG. 5 is a schematic view of components in an embodiment of the present invention.

Still referring to FIG. 5, a computer system 530 receives signals from the sensor 300 via the cable 520 and the data bus 501. The computer system 530 includes a processor and, typically, volatile and non-volatile memory for data storage. The computer system 530 may also include analog-to-digital (A/D) circuitry to convert the analog signal from the sensors 300 to digital form for analysis, and any additional circuitry necessary to operate the sensors 300—e.g., a voltage or current source in the case of FSRs. Alternatively, such circuitry and/or measurement and/or A/D circuitry may be housed in a device (not shown) physically separate from the computer system 530. The computer system 530, which may be a personal computer, typically stores digital data in the memory and is programmed to calculate the normal load or web tension from the data received. The computer system 530 then compares the calculated value to a stored set value, which can be a range of values, and generates a signal output in digital or analog form corresponding to the adjustment in the web tension that should be made. In other words, if the calculated value, which is related to the web tension, is at the set value, the computer system 530 generates a signal that no action is required or simply does not generate an action signal. If the calculated value is not at the set value, the computer system 530 generates a signal for tension adjustment.

It should be stressed that computer system 530 need not explicitly compute the web tension from sensor data. For example, the data received by the computer system 530 may be the resistance of the sensor 300; this is only indicative of the normal load exerted by web 120 on the sensor 300; this, in turn, indicates the web tension. The computer system 530 may compare the detected sensor resistance to a set resistance value and generate an adjustment signal based on the difference.

Still referring to FIG. 5, when the computer system 530 generates a signal for adjustment, the signal is sent via a signal bus 550 to the displacement device. The displacement device can function together with other tensioning apparatus such as a device 560 which controls a cylinder drive, a device 570 which controls the cylinder motor, a device 580 which controls the motor for a web-supply spool, and the device 590 which controls the motor for a web-uptake spool. These optional apparatus may adjust the web tension through rotating respective motors. As the web is tightened, web tension increases, and vice versa. These apparatus may involve a drive or a brake.

Use of these other tensioning apparatus may be important for tension adjustment purposes. When the displacement device of the present invention moves a portion of the web material closer to a tangent plane at a contact point, it might also be moving the winding device (e.g., spools) closer to the contact point, which will loosen the web-wrapping around the cylinder, countering the modulatory effect of the displacement device. However, the adverse effect can be controlled using one of the tensioning apparatus mentioned above, e.g., to rotate the spool to tighten up the web wrapping.

Figure 6A:
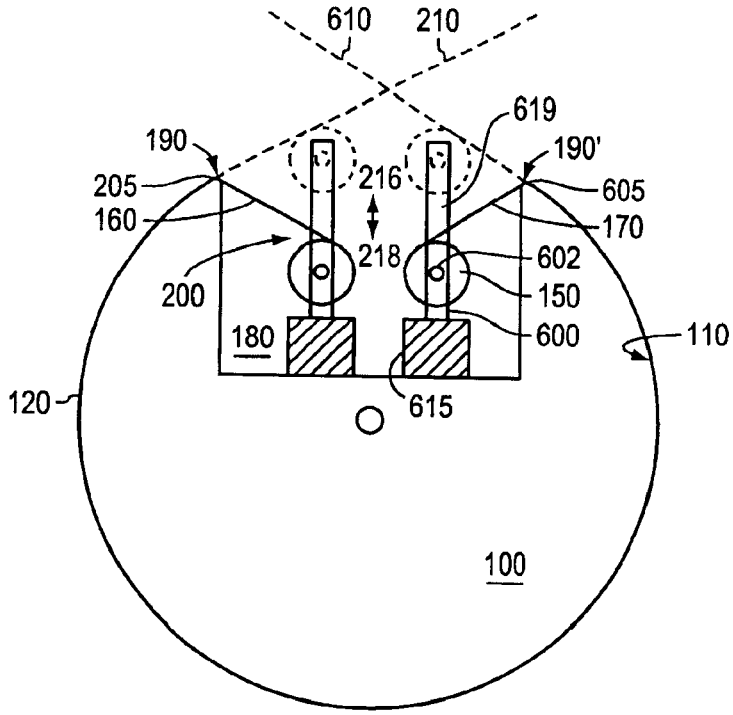
FIGS. 6A and 6B are partially schematic end views of displacement devices in accordance with the present invention.

Alternatives to aspects of the displacement device shown in FIG. 2 will now be described. Referring to FIG. 6A, a displacement device 600 displaces a winding device, e.g., the uptake spool 150 which rotates around its axis 602, and receives the web material 120 from the cylinder's circumferential surface 110. The device 600 may be utilized in conjunction with, or separate from, the displacement device 200 already described in connection with FIG. 2.

Specifically, the web material 120 leaves the cylinder surface 110 around the exit edge 190' of the cavity 180 in the cylinder 100. Then along the exit path 170, the web 120 is wound onto the uptake spool 150. The exit path 170 extends from a contact point 605 around the edge 190' where the web material 120 departs from the cylinder surface 110 to the surface of the uptake spool 150. Like the contact point 205 around the feed edge 190, it has been found that tension loss is minimized if the exit path 170 is in a plane 610 that is tangent to the cylinder 100 at the contact point 605.

The displacement device 600 adjusts the web tension by displacing a portion of the web material 120 in relation to the tangent plane 610 at the contact point 605. The displacement device may use an actuating mechanism similar to those described in connection with the device 200 to displace the web material 120. The exemplary displacement device 600 shown in FIG. 6A has a base 615 disposed in the cavity 180 and displaces the web material 120 by displacing the uptake spool 150 along a linear trajectory indicated by the arrows 216 and 218 within a frame 619. It should be understood that the frame 619 can be constructed to be wholly or partially curved such that the spool 150 travels along a curved trajectory.

As the uptake spool 150 moves in the direction of arrow 216, the exit path 170 gets closer to the tangent plane 610, and less web tension is lost at the contact point 605. Conversely, as the uptake spool 150 moves in the direction of arrow 218, the exit path 170 gets farther away to the tangent plane 610, and more web tension is lost at the contact point 605. Therefore, the frame 619 can be designed to set limits that correspond to a range of desired tension adjustment. To minimize web tension loss, the exit path 170 is ideally in the tangent plane 610. However, in some applications, such as where another cylinder surface is in rotational contact with the cylinder 100, it may be necessary to retain the surface of the winding device within the cylinder's envelope. In those cases, the displacement device 600 can move the exit path 170 as far as it can in the direction of arrow 216, such that the feed path 170 is substantially in the tangent plane 610. Moreover, the curvature of the edge at the contact point 605 may be contoured to bring the tangent plane 610 closer to or within the cylinder envelope.

Devices 600 and 200 may operate separately. Each may receive actuation signals from the same or separate sources, e.g., processors. Each source may be further connected to the same or separate sensing systems that generate data on the web tension. It may be advantageous for the device 600 to be more responsive to data received from a sensor closer to the exit edge 190', with the device 200 being more responsive to data received from a sensor closer to the feed edge 190.

Figure 6B:
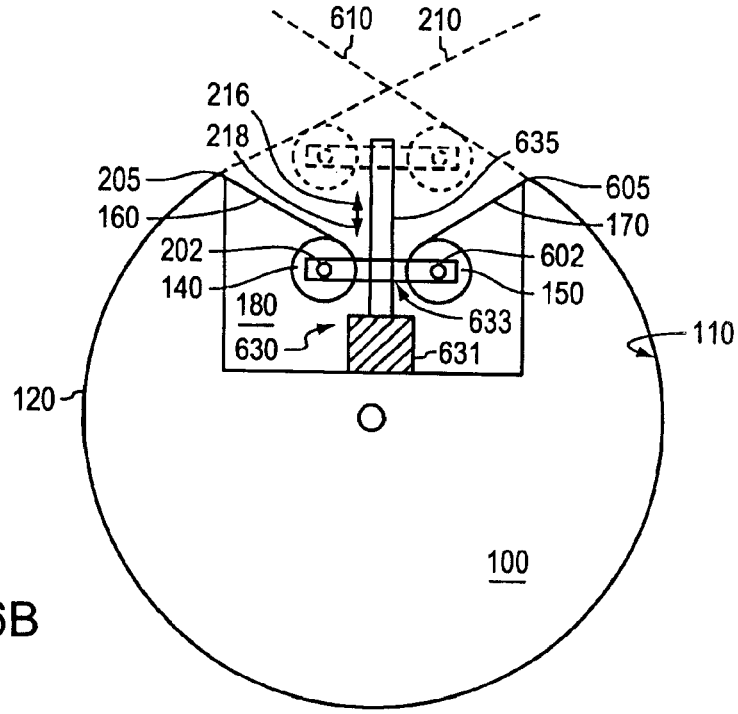

FIG. 6B illustrates another embodiment of the invention. A displacement device 630 displaces more than one winding device at the same time. The device 630 may include a base 631 disposed in the cavity 180, and a horizontal shaft 633 that moves the axis 202 of the supply spool 140 together with the axis 602 of the uptake spool 150. The horizontal shaft 633 is displaceable by an actuation mechanism similar to those described earlier in connection with the device 200, along a trajectory indicated by arrows 216 and 218. The trajectory may also be partly or entirely curved. The horizontal shaft 633 may be confined to move within a frame 635 which sets the limits for tension adjustment.

Similar to the embodiments described earlier, as the displacement device 630 causes the spools 140 and 150 to move in the direction of arrow 216, both the feed path 160 and the exit path 170 for the web material 120 approach the tangent planes 210 and 610, respectively, resulting in reduced loss of web tension at the contact points 205 and 605. Conversely, as the spools 140 and 150 move in the direction of arrow 218, the paths 160 and 170 retreat from the tangent planes 210 and 610, and web tension is attenuated.

Figure 7A:
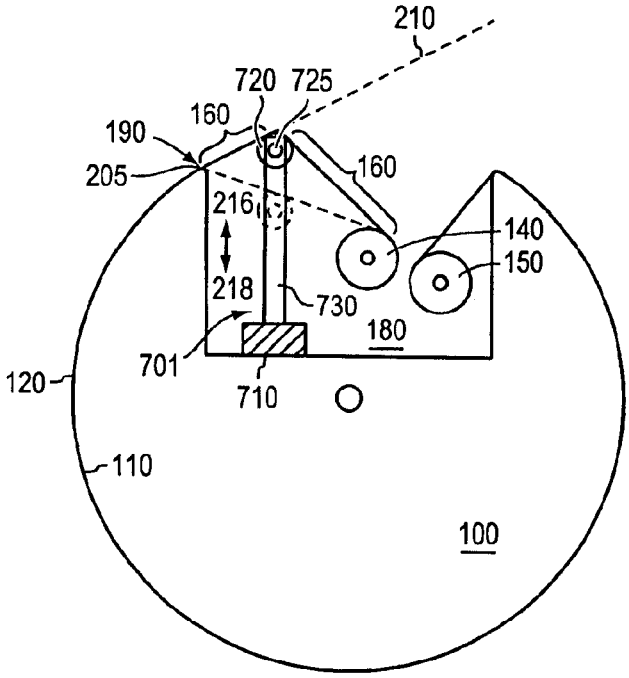
FIGS. 7A and 7B are partially schematic end views of further embodiments of displacement devices in accordance with the present invention.
Figure 7B:
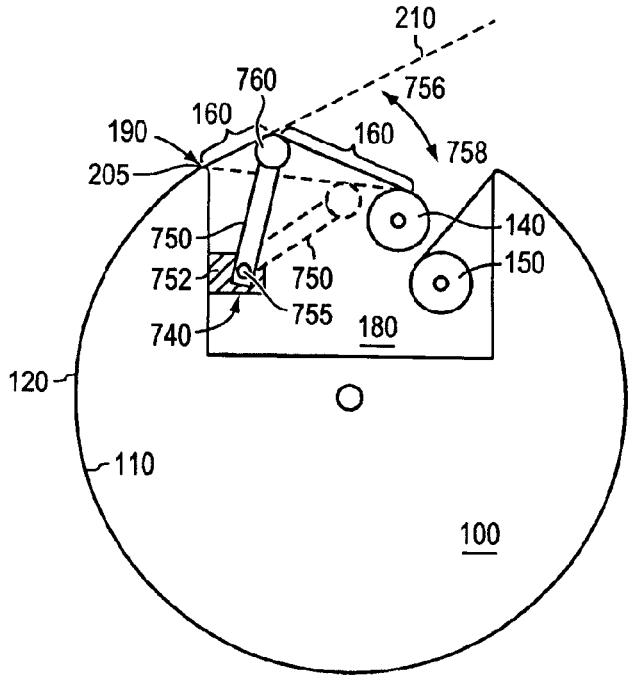

FIGS. 7A and 7B illustrate further embodiments of the replacement device in accordance with the present invention. Both embodiments are illustrated in connection with the supply spool 140, but it should be understood that the embodiments can be used in connection with the uptake spool 150 or both spools or multiple pairs of supply-uptake spools.

Referring to FIG. 7A, a supply spool 140 is disposed in the cavity 180 of the cylinder 100, and feeds a web material 120, along a feed path 160 to a contact point 205 around the feed edge 190. A displacement device 701 is also disposed in the cavity 180. The displacement device 701 may optionally include a base 710 and an actuation mechanism for displacing a dancer roll 720. The actuation mechanism may be similar to those described earlier in connection with the device 200. For example, a hydraulic motor or piston may be connected to the dancer roll's axis 725, displacing the axis 725 within a frame 730 in the directions indicated by arrows 216 and 218. The frame 730 controls the trajectory of the displacement and may be linear as shown or curved. The web material 120 is in contact with part of the dancer roll 720, specifically, on top of the dancer roll 720. Therefore, the feed path 160 is affected by the position of the dancer roll 720.

Similar to prior-described embodiments of the displacement device, the device 701 adjusts the web tension by displacing a portion of the web path in relation to the tangent plane 210: closer, more tension; farther away, less tension. As shown in solid line, when the dancer roll 720 approaches the tangent plane 210, at least a portion of the feed path 160 becomes substantially inside the tangent plane 210.

Referring to FIG. 7B, a supply spool 140 is similarly disposed in the cavity 180 of the cylinder 100, and feeds a web material 120 along a feed path 160 to a contact point 205 around the feed edge 190. A displacement device 740 with an angular displacement arm 750 hinged to a base 752 is provided. The displacement device 740 includes an actuation mechanism for angularly displacing the arm 750. The actuation mechanism may be similar to those described earlier in connection with the device 200. For example, a stepper motor may control the angular rotation of the arm 750 at hinge 755 in the directions indicated by arrows 756 and 758. As a result, a round tip 760 of the arm 750 travels along a curved trajectory. The web material 120 is in contact with the distal, rounded portion of the arm 750. Therefore, the feed path 160 is affected by the position of the arm 750.

Angular displacement of the arm 750 results in modulation of web tension loss at the contact point 205. As the feed path 160 gets closer to the tangent plane 210 due to movement of the arm 750 in the direction of arrow 756, more tension gets distributed to the rest of the web material around the cylinder surface 110 and vise versa.

Figure 8A:
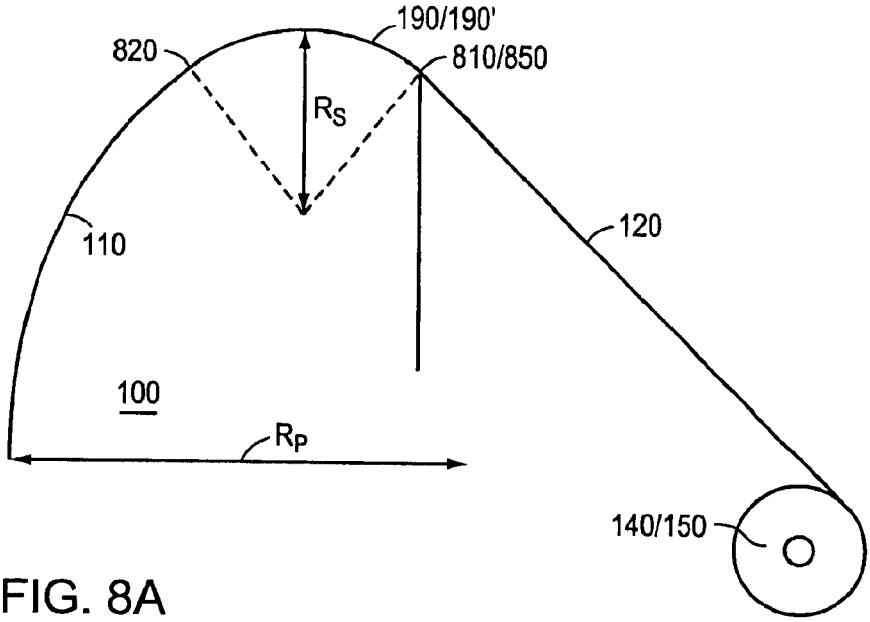
FIG. 8A (PRIOR ART)
FIG. 8A shows details of a portion of a web-handling cylinder.

Referring now to FIG. 8A, the portion of the cylinder 100 near one of its edges 190/190' is shown in greater detail. As shown here, the edge 190/190' may be round and follows an are between points 810 and 820. While most of the cylinder surface 110 has a cross-sectional radius $R_p$ (primary radius), the edge 190/190' has a cross-sectional radius $R_s$ (secondary radius) that is different from $R_p$, typically smaller. While this design may be desirable for smoothly transitioning a web material 120 onto or off the cylinder surface 110, it has been shown to contribute to the web tension loss at the web-contact point 850 which tends to be point 810.

Figure 8B:
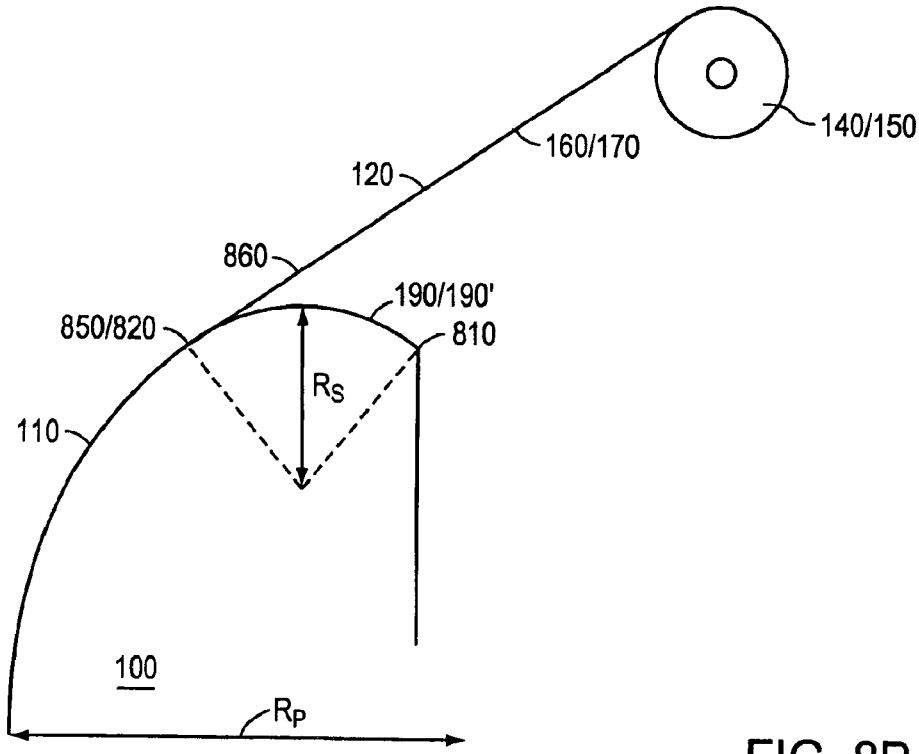
FIG. 8B illustrates an aspect of the invention that overcomes the structural limitation shown in FIG. 8A.

In another aspect of the present invention and referring to FIG. 8B, the displacement device (not shown) of the invention reduces web tension loss at the web-contact point 850 by displacing the feed/exit path 160/170 such that the web-contact point 850 is not on the edge 190/190' with the secondary radius. For example, the contact point 850 may be the point 820 where the edge 190/190' borders the rest of the cylinder surface 110. The contact point 850 may be behind the edges, i.e., having a cross-sectional radius $R_p$ and not $R_s$.

Figure 9:
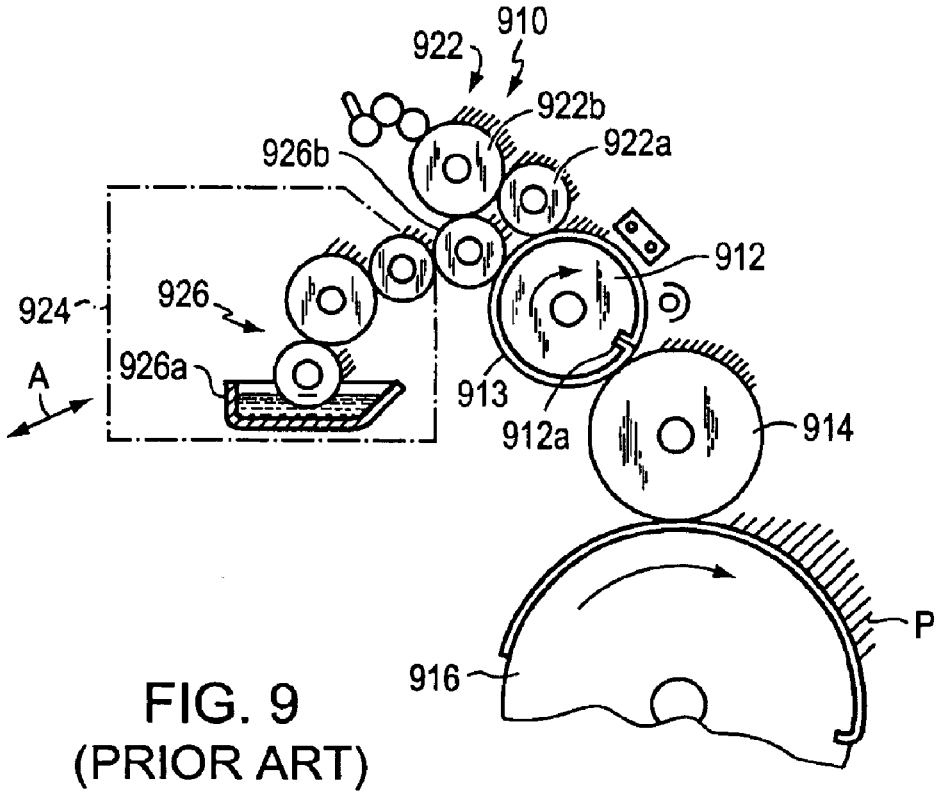
FIG. 9 (PRIOR ART)
FIG. 9 is a partial diagrammatic view of an offset press with a lithographic printing plate which can incorporate the present invention.

As noted previously, the invention is useful in conjunction with any type of mechanism that advances sheet or web material around a cylinder (e.g., web-coating systems, paper-making systems, printing systems, etc.). The components shown in FIG. 5 pertain to implementation in an on-press imaging environment, such as that illustrated in FIGS. 9 and 10, which will now be described. Refer to FIG. 9, which shows a more or less conventional offset press shown generally at 910 that can print copies using lithographic plates made in accordance with this invention.

Press 910 includes a print cylinder or drum 912 around which is wrapped a lithographic plate 913 whose opposite edge margins are secured to the cylinder 912 by a conventional clamping mechanism 912*a* incorporated into cylinder 912. Cylinder 912, or more precisely the plate 913 thereon, contacts the surface of a blanket cylinder 914 which, in turn, rotates in contact with an impression cylinder 916. The paper sheet P to be printed on is mounted to the surface of cylinder 916 so that it passes through the nip between cylinders 914 and 916 before being discharged to the exit end of the press 910. Ink for inking plate 913 is delivered by an ink train 922, the lowermost roll 922*a* of which is in rolling engagement with plate 913 when press 910 is printing. As is customary in presses of this type, the various cylinders are all geared together so that they are driven in unison by a single-drive motor.

The illustrated press 910 is capable of wet as well as dry printing. Accordingly, it includes a conventional dampening or fountain assembly 924 which is movable toward and away from drum 912 in the directions indicated by arrow A in FIG. 9 between active and inactive positions. Assembly 924 includes a conventional water train shown generally at 926, which conveys water from a tray 926*a* to a roller 926*b* which, when the dampening assembly is active, is in rolling engagement with plate 913 and the intermediate roller 922*b* of ink train 922.

When press 910 is operating in its dry printing mode, the dampening assembly 924 is inactive so that roller 926*b* is retracted from roller 922*b* and the plate 913 so that no water is applied to the plate. The lithographic plate 913 on cylinder 912 in this case is designed for such dry printing. As the cylinder 912 rotates, the plate 913 is contacted by the ink-coated roller 922*a* of ink train 922. The areas of the plate surface that have been written on and thus made oleophilic pick up ink from roller 922*a*. Those areas of the plate surface not written on receive no ink. Thus, after one revolution of cylinder 912, the image written on the plate will have been inked. That image is then transferred to the blanket cylinder 914 and, finally to the paper sheet P which is pressed into contact with the blanket cylinder.

When press 910 is operating in its wet printing mode, the dampening assembly 924 is active so that the water roller 926*b* contacts ink roller 922*b* and the surface of the plate or web 913, which is intended for wet printing. It has a surface that is hydrophilic except in the areas thereof which have been written on to make them oleophilic. Those areas, which correspond to the printed areas of the original document, shun water. In this mode of operation, as the cylinder 912 rotates (clockwise in FIG. 9), water and ink are presented to the surface of plate 913 by the rolls 926*b* and 922*a*, respectively. The water adheres to the hydrophilic areas of that surface corresponding to the background of the original document and those areas, being coated with water, do not pick up ink from roller 922*a*. On the other hand, the oleophilic areas of the plate surface (which have not been wetted by roller 926) pick up ink from roller 922*a*, again forming an inked image on the surface of the plate. As before, that image is transferred via blanket roller 914 to the paper sheet P on cylinder 916.

Figure 10:
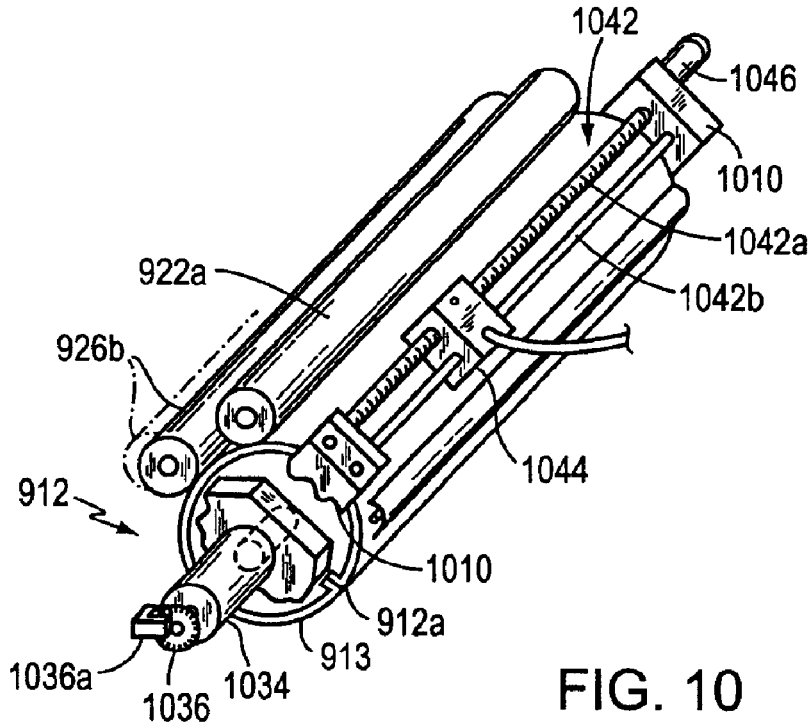
FIG. 10 (PRIOR ART)
FIG. 10 is an isometric view on a larger scale showing in greater detail the plate cylinder portion of the FIG. 9 press.

While the image to be applied to the lithographic plate 913 can be written onto the plate while the plate is "off press," the present invention lends itself to imaging of a plate already mounted on the print cylinder 912. As shown in FIG. 10, the print cylinder 912 is rotatively supported by the press frame 1010 and rotated by a standard electric motor 1034 or other conventional means. The angular position of cylinder 912 is monitored by conventional means such as a shaft encoder 536 that rotates with the motor armature and associated detector 536*a*.

Also supported on frame 1010 adjacent to cylinder 1012 is a writing head assembly shown generally at 1042. This assembly comprises a lead screw 1042*a* whose opposite ends are rotatively supported in the press frame 1010, which frame also supports the opposite ends of a guide bar 1042*b* spaced parallel to lead screw 1042*a*. Mounted for movement along the lead screw and guide bar is a carriage 1044. When the lead screw 1042*a* is rotated by a step motor 1046, carriage 1044 is moved axially with respect to print cylinder 912. The cylinder drive motor 1034 and step motor 1046 are operated in synchronism by a controller (not shown), which also receives signals from detector 1036*a*, so that as the drum rotates, the carriage 1044 moves axially along the drum with the controller "knowing" the instantaneous relative position of the carriage and cylinder at any given moment. The control circuitry required to accomplish this is well known in the scanner and plotter art; see also U.S. Pat. No. 5,174,205, incorporated herein by reference.

As discussed above, the plate or web may take the form of a rolled supply of material stored within cylinder 912 (in contrast to the traditional sheet configuration that must be individually wrapped around the cylinder). Moreover, multiple continuous supplies of plate/web material may be utilized, to reduce the frictional forces exerted on the plate material by the plate cylinder and to provide for multiple printing sections.

Figure 11:
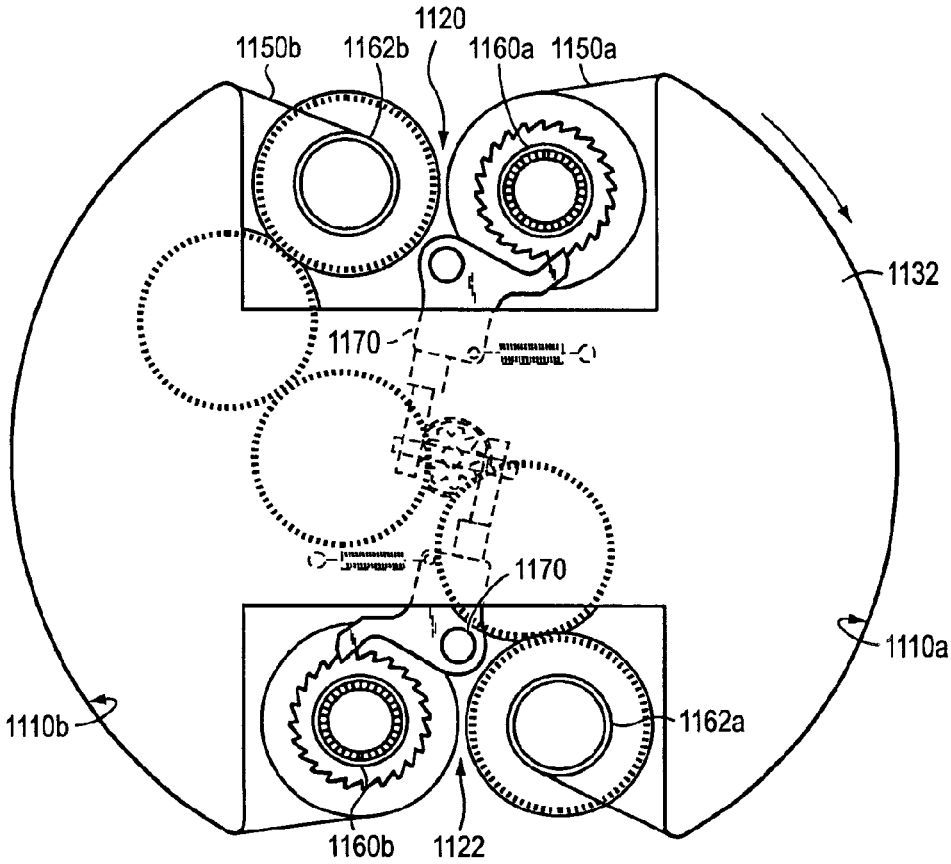
FIG. 11 (PRIOR ART)
FIG. 11 is an end view of a plate cylinder employing a dual-plate material configuration with diametrically opposed printing segments, showing two pairs of supply and uptake components distributed in opposed cavities of the plate cylinder, which can also incorporate the present invention.

FIG. 11 illustrates components of a prior-art plate material supply and uptake apparatus, which is adapted for a dual-plate configuration with diametrically opposed printing segments 1110*a* and 110*b*. The web material supply and uptake components in FIG. 11 are located in a pair of opposed cavities 1120, 1122 within cylinder 1132. For example, a first segment 1150*a* of web (or other recording) material wraps around a 1110*a* portion of the circumference of cylinder 1132, extending from a supply spool 1160*a* rotatable within cavity 1120 to an uptake spool 1162*a* rotatable within cavity 1122. And a second segment 1150*b* of web material wraps around an opposed portion 1110*b* of the surface of cylinder 1132, extending from a supply spool 1160*b* rotatable within cavity 1122 to an uptake spool 1162*b* rotatable within cavity 1120. A ratchet-pawl system 1170 controlling the amount of web dispensed is connected to each set of supply and uptake spools. Whether a plate cylinder is wrapped with a single supply or multiple segmented supplies of web material, it can benefit from the present invention.

Figure 12:
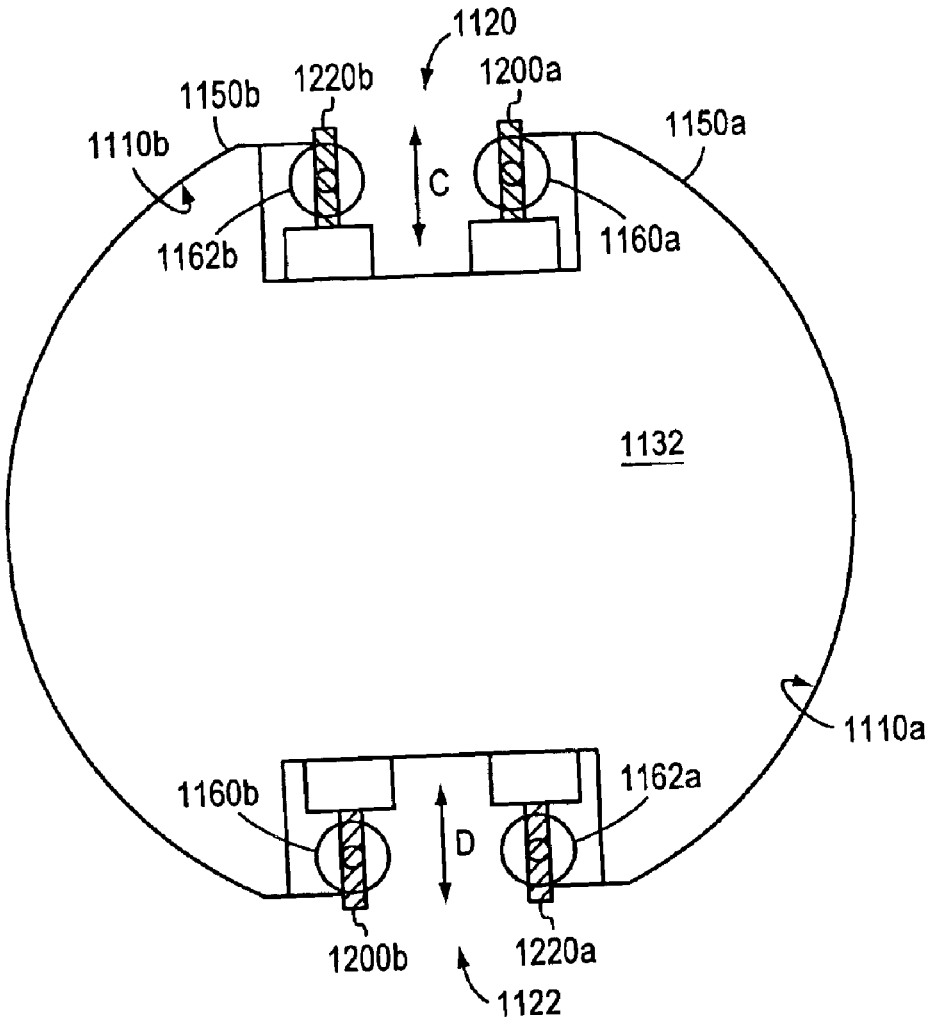
FIG. 12 is an end view of a plate cylinder having multiple cavities hosting multiple pairs of web-supply and uptake spools and their respective actuation devices in accordance with an alternative embodiment of the present invention.

FIG. 12 illustrates how the displacement device of the present invention can be adapted for a multi-segment web-loading configuration. The plate cylinder 1132 has two opposed cavities 1120 and 1122 separating diametrically opposed printing segments 1110*a* and 1110*b*. For example, a first segment 1150*a* of web (or other recording) material wraps around a 1110*a* portion of the circumference of cylinder 1132, extending from a supply spool 1160*a* rotatable within cavity 1120 to an uptake spool 1162*a* rotatable within cavity 1122. And a second segment 150*b* of web material wraps around an opposed portion 110*b* of the surface of cylinder 1132, extending from a supply spool 1160*b* rotatable within cavity 1122 to an uptake spool 1162*b* rotatable within cavity 1120. A displacement device, e.g., the embodiment described in connection with FIG. 2 or 6A can be used to displace any of the four spools. In one embodiment, the spools 1160*a* and 1162*a* are controlled by displacement devices 1200*a* and 1220*a* respectively to move along the arrows C and D. Similarly, the spools 1160*b* and 1162*b* are also controlled by displacement devices 1200*b* and 1220*b* respectively to move along the arrows C and D.

While FIG. 12 portrays a dual-segment web-loading configuration, it should be recognized that this configuration is exemplary only; the present invention can include more than two pairs of uptake and supply spools and/or more than two cavities distributed evenly or otherwise around the cylinder.

In a multi-segment cylinder, the displacement device of the present invention can function together with a tensioning roll that moves into contact with a web when more normal web force is needed. Such a tensioning roll is disclosed in co-owned U.S. Pat. No. 6,325,322, which is incorporated herein by reference.

The terms and expressions employed herein are used as terms of description and not limitation, and there is no intention, in the use of such terms and expressions, of excluding any equivalents of the features shown and described or portions thereof, but it is recognized that various modifications are possible within the scope of the invention.

What is claimed is:

1. A web-handling system comprising:

a) a cylinder including a circumferential surface;

b) a first winding device disposed in the cylinder for feeding a web material onto the circumferential surface of the cylinder along a feed path;

c) a second winding device also disposed in the cylinder for receiving the web material off the circumferential surface of the cylinder along an exit path; and d) a displacement device for displacing at least one of the paths of the web material.

2. The system of claim 1 wherein the displacement device displaces at least one of the winding devices.

3. The system of claim 1 wherein the displacement device comprises a dancer roll in contact with the at least one of the paths.

4. The system of claim 1 wherein the displacement device comprises an angular displacement arm in contact with the at least one of the paths.

5. The system of claim 1 wherein the displacement device travels along a linear trajectory.

6. The system of claim 1 wherein the displacement device travels along a curved trajectory.

7. The system of claim 1 wherein the web material feeds onto or comes off the surface of the cylinder at a contact point on the cylinder surface, the displacement device displacing at least one of the paths in relation to a plane tangent to the contact point.

8. The system of claim 7 wherein the displacement device is capable of maintaining the at least one of the paths substantially in the tangent plane.

9. The system of claim 1 wherein at least one pair of edges of the circumferential surface is round and differs from the rest of the circumferential surface in radius.

10. The system of claim 1 further comprising a sensing device that senses a tension in the web, said sensing device generating a signal to actuate the displacement device.

11. The system of claim 10 wherein the sensing device actuates the displacement device when sensing a loss of tension.

12. The system of claim 10 wherein the sensing device comprises a sensor associated with the circumferential surface of the cylinder for detecting a force applied by the web against the surface.

13. The system of claim 12 wherein the sensor is selected from the group consisting of a force-sensitive resistor, a load cell and a piezo-electric sheet based sensor.

14. The system of claim 10 further comprising a processor for receiving an input from the sensing device, processing the input and sending an output to the displacement device.

15. The system of claim 14 wherein the system maintains a set value for the tension in the web.

16. The system of claim 15 wherein said set value comprises a range.

17. The system of claim 1 wherein the cylinder comprises a cavity and both the first and second winding devices are disposed in the same cavity.

18. The system of claim 1 further comprising multiple first winding devices and multiple second winding devices.

19. The system of claim 18 wherein the system comprises multiple cavities and wherein the winding devices are disposed in the multiple cavities.

20. A web-winding device for wrapping a web material around a cylinder along a travel path leading from an interior of the cylinder over a surface thereof and back into the interior of the cylinder, the device including a tension adjuster for adjusting a tension in the web material by displacing a portion of the web material in relation to a plane tangent to a contact point on the cylinder, the contact point being where the portion of the web material leads onto or comes off the cylinder surface, and the tension adjuster being configured to contact the web material only between a rotational axis of the cylinder and the tangent plane at the contact point.

21. The device of claim 20 wherein the web-winding device comprises a spool.

22. The device of claim 20 wherein the web-winding device comprises multiple spools configured to reside in multiple cavities.

23. The device of claim 20 wherein the device comprises an actuation mechanism that displaces the device along a linear trajectory.

24. The device of claim 20 wherein the device comprises an actuation mechanism that displaces the device along a curved trajectory.

25. The device of claim 20 wherein the device comprises a sensor for sensing information related to the tension in the web material and an actuation mechanism responsive to the sensor for activating the tension adjuster to displace the portion of the web material.

26. A method for adjusting tension in a web material feeding onto and coming off a circumferential surface of a cylinder, the method comprising displacing a portion of the web material only between a rotational axis of the cylinder and a plane tangent to a contact point on the circumferential surface of the cylinder, the contact point being where the portion of the web material feeds onto or comes off the surface of the cylinder.

27. The method of claim 26 further comprising maintaining the portion of the web material substantially in the tangent plane.

28. The method of claim 26 wherein the web material is displaced by an angular displacement arm.

29. The method of claim 26 wherein the web material is displaced by a dancer roll.

30. The method of claim 26 wherein the circumferential surface of the cylinder comprises at least one pair of edges, each pair of edges defining a cavity in the cylinder, the web material being wound on at least one spool disposed in one of the cavities.

31. The method of claim 30 wherein the web material is displaced by the at least one spool.

32. The method of claim 30 wherein the at least one pair of edges are round and differ from the rest of the circumferential surface in radius.

33. The method of claim 32 comprising displacing the portion of the web material such that the contact point is not on the at least one pair of edges.

34. The method of claim 26 wherein the web material is displaced along a linear trajectory.

* * * * *